United States Patent [19]

Marie

[11] Patent Number: 4,747,534

[45] Date of Patent: May 31, 1988

[54] EXTENSIBLE HANDLE FOR A CARTON AND BLANK THEREFOR

[75] Inventor: Philippe Marie, Chateauroux, France

[73] Assignee: The Mead Corporation, Dayton, Ohio

[21] Appl. No.: 34,889

[22] Filed: Apr. 6, 1987

[30] Foreign Application Priority Data

Apr. 3, 1986 [GB] United Kingdom ..... 8608171

[51] Int. Cl.[4] ..... B65D 5/46

[52] U.S. Cl. ..... 229/52 B; 206/141; 229/40

[58] Field of Search ..... 206/141, 427; 229/40, 229/52 B, 52 BC, 52 A, 52 AL; 383/14

[56] References Cited

U.S. PATENT DOCUMENTS

| | | | |
|---|---|---|---|
| 2,723,027 | 11/1955 | Guyer | 229/52 B |
| 2,955,739 | 10/1960 | Collura | 229/52 B |
| 2,981,458 | 4/1961 | Thibault | 229/52 AL |
| 3,005,546 | 10/1961 | Sanford | 229/52 B |

FOREIGN PATENT DOCUMENTS

| | | | |
|---|---|---|---|
| 1423905 | 11/1965 | France | 229/52 B |
| 1429884 | 1/1966 | France | 229/52 B |
| 2467145 | 5/1981 | France | 229/52 B |

*Primary Examiner*—S. Marcus
*Assistant Examiner*—Gary E. Elkins
*Attorney, Agent, or Firm*—Erwin Doerr

[57] ABSTRACT

An extensible handle (22) spanning a top panel of a carton is being extensible from a flat stowed position in which a central hand gripping portion (26) of the handle lies substantially in the plane of the top panel to an extended position in which the hand gripping portion is raised out of the plane of the top panel. The handle includes a hinged gusset portion (40) which lies in superposed relationship with a part of the handle when the handle is in its stowed position and which is hinged out of its superposed relationship when the handle is grasped to lift the carton thereby to allow the handle to extend.

5 Claims, 5 Drawing Sheets

EXTENSIBLE HANDLE FOR A CARTON AND BLANK THEREFOR

This invention relates to an extensible handle which is incorporated in a packaging carton and the blank for forming the carton.

It often is not easy to grip a carton carrying handle which lies flat on the top of a carton such as a multipack of primary containers since in many constructions there is not sufficient space in which to slide a hand between the packaging material of the carton and the packaged items in order to lift the carton.

It is known from No. DE-27 56 374 to provide a carton handle which is extensible when the handle is gripped to lift the carton. However, in this prior construction hinged tabs adjoining the sides of the handle allow the handle to be raised out of the plane of the top panel. The hinged tabs are small compared to the width of the handle and are susceptible to tearing.

The present invention improves the resistance to tear in an extensible handle by forming a hinged gusset which constitutes a portion of the overall length of the handle itself.

To this end, the invention provides in a packaging carton an extensible handle spanning a top panel of the carton and being extensible from a flat stowed position in which a central hand gripping portion thereof lies substantially in the plane of said top panel to an extended position in which said hand gripping portion is raised out of the plane of the top panel characterised in that the handle includes a hinged gusset portion which lies in superposed relationship with a part of the handle when the handle is in its stowed position and which is hinged out of said superposed relationship when the handle is grasped to lift the carton thereby to allow the handle to extend.

Two embodiments of the invention will now be described by way of example with reference to the accompanying drawings in which.

Figure 1:
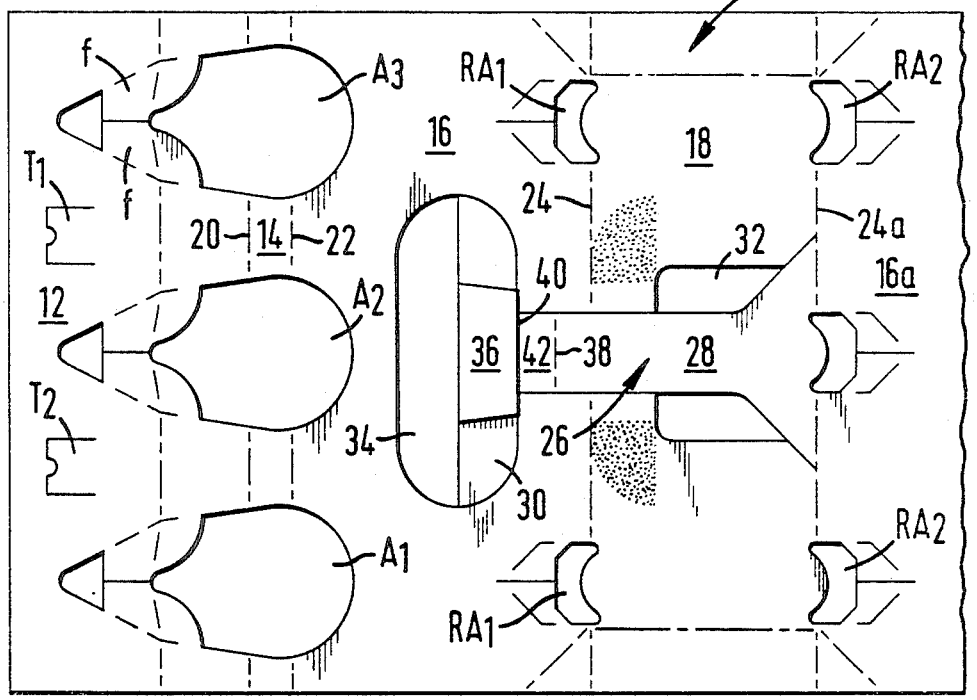
FIG. 1 is a plan view of a portion of a carton blank as seen from the underside thereof having an extensible handle arrangement according to the invention but in which the construction is incomplete.
Figure 2:
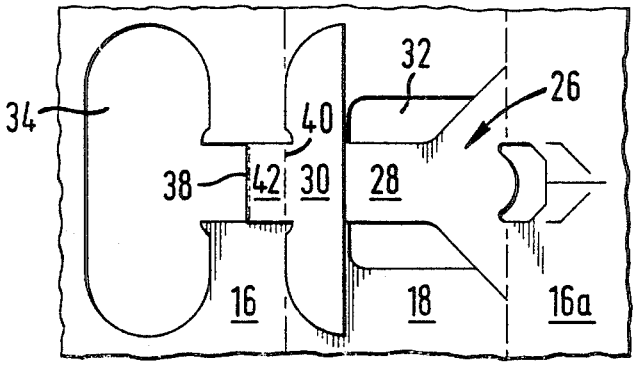
FIG. 2 is a detail view showing only the handle arrangement on the blank in completed form.

Referring first to FIGS. 1 and 2 of the drawings, a part elongate blank 10 for forming a wraparound type carton 'C' (FIGS. 3 and 4) is formed from a paperboard or similar foldable sheet material. The blank comprises a first base panel 12, a lower side wall panel 14 an upper side wall panel 16, a top panel 18 and like panels on the opposite side of the top panel shown only in FIGS. 3 and 4 having like reference numerals with the addition of suffix 'a'. These main panels are hinged one to the next along transverse fold lines 20, 22, 24 respectively.

The base panel 12 includes retaining apertures defined by retaining tabs T1, T2 into which locking tabs (not shown) provided in the opposite base panel **12*a* of the carton are engaged to secure the base panels together in overlapping relationship. A series of bottle heel retaining apertures A1–A3 is struck partially from the side wall panels 14, 16 and partially from the base panel 12**, each heel retaining aperture having a pair of bottle heel protecting flaps 'f'.

Two parallel rows of bottle top receiving apertures RA1 and RA2 are struck from the blank substantially along transverse fold lines 24 and **24*a*** respectively.

Referring to FIG. 1 and 2, a handle 26 comprising a strip of material struck from the blank has one of its ends defined by a mid-section of the transverse fold line **24*a*; a central hand gripping portion 28 extending across the top panel 18 and the other of its ends 30 secured to the underside of the top panel intermediate a central hand gripping aperture 32 formed in top panel 18 and the transverse fold line 24**.

End 30 of the handle comprises a transversely elongate flap which is struck from an ovate aperture 34 formed in side panel 16. As shown in FIG. 1 a reinforcing tap 36 is folded and secured in overlapping relationship onto the underside of the end flap 30. The opposite ends of the end flap 30 are secured to these areas of the top panel 18 shown in stippling in FIG. 1 by being folded into overlapping relationship with the top panel about a fold line 38. Fold line 38 is formed intermediate the ends of the handle strip 26 and together with a like fold line 40 formed immediately adjacent the end flap 30 defines a gusset panel 42. Fold line 40 is coincident with transverse fold line 24 and fold line 38 defines the free end of the handle when the end flap is secured to the top panel as shown in FIG. 2.

Figure 3:
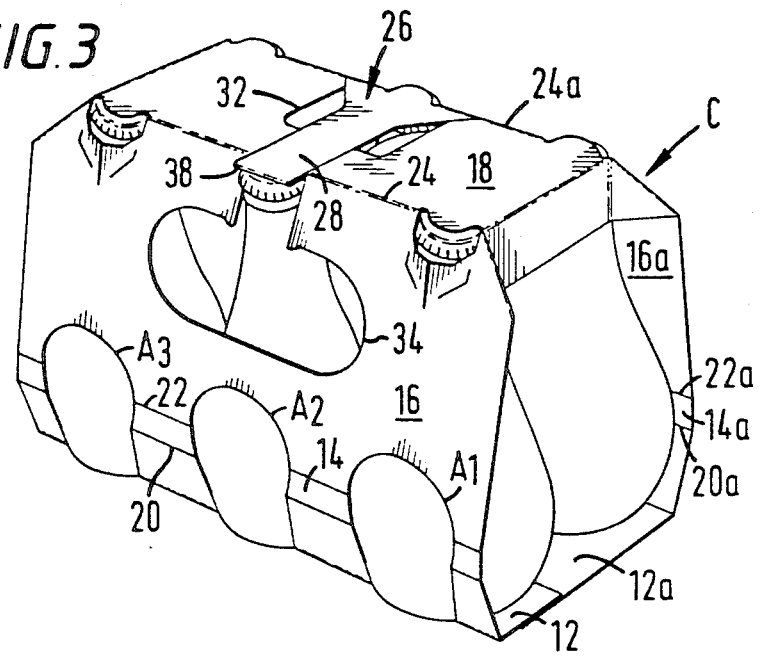
FIG. 3 is a perspective view of a carton of the wraparound type incorporating an extensible handle according to the invention.
Figure 4:
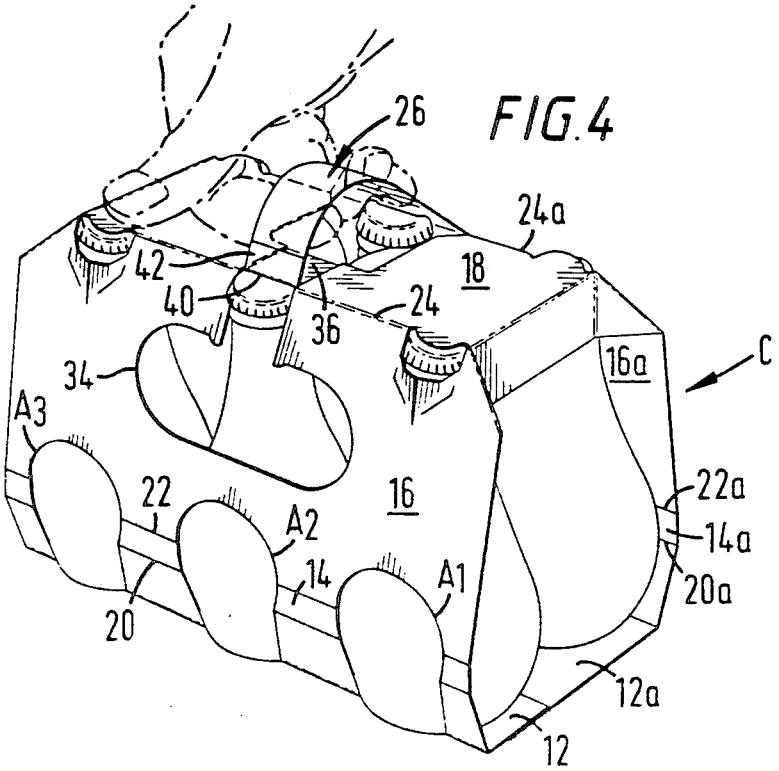
FIG. 4 is a view similar to FIG. 3 but showing the handle gripped and raised relative to the top of the carton.

Referring now to FIGS. 3 and 4, in the completed carton, when the handle is in its stowed position, as shown in FIG. 3, the gusset 42 lies in flap superposed relationship under that part of the handle which is between fold line 38 and fold line 4O (24) and is seated on the top of a bottle top BT packaged within the carton whereby the fold line 38 defines the marginal edge of the handle.

Referring to FIG. 4, when the handle is grasped to lift the carton, the gusset 42 is rotated out of its flat superposed position by hinging about fold line 38 and 40 so that the handle is extended by a length representing the distance between those fold lines. Thus, the handle can be manipulated so that its central hand gripping portion is raised out of the plane of the top panel whereby the fold line 40 then defines the end edge of the handle.

In the particular carton shown the bottles are arranged in two rows of three bottles and two further bottles are interposed in the spaces between the outermost and central bottles on either side of the handle, the interposed bottles being inverted relative to the other bottles.

Figure 5:
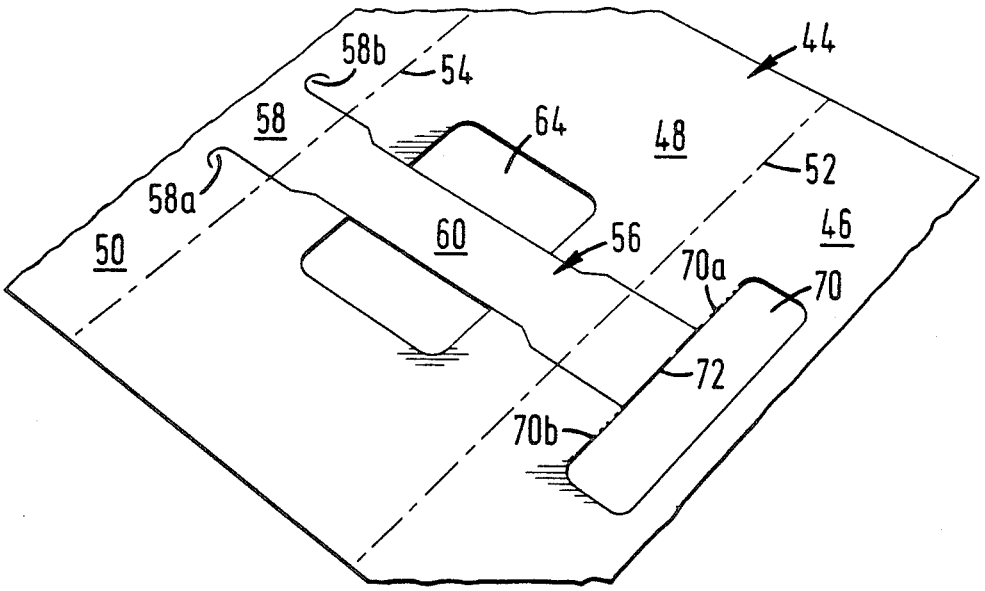
FIG. 5 is a perspective view of part of another carton blank in which a handle is shown lying substantially in the plane of the blank.
Figure 6:
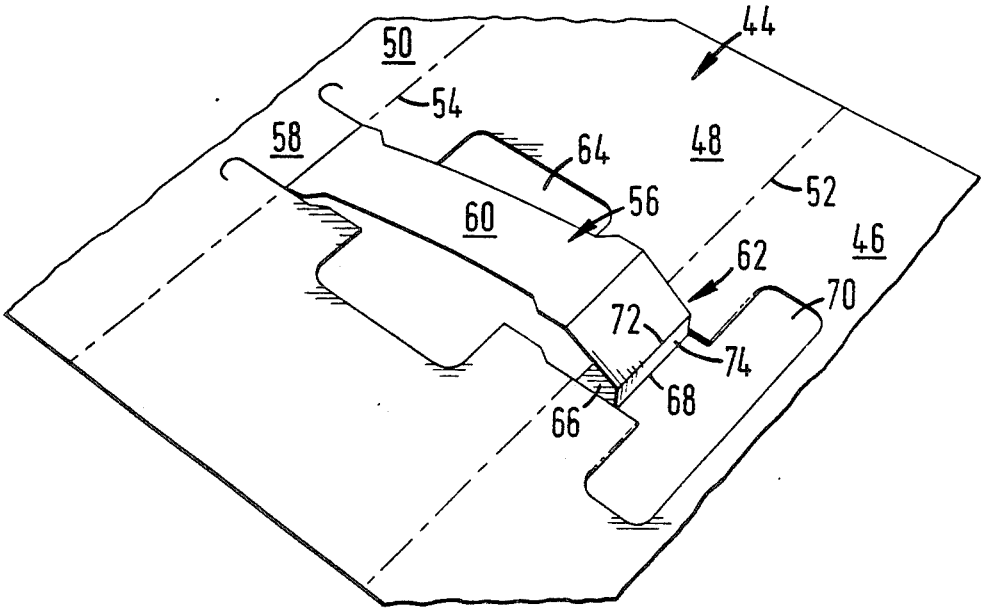
FIG. 6 is a view similar to FIG. 1 but in which the handle is shown raised out of the plane of the blank.
Figure 7:
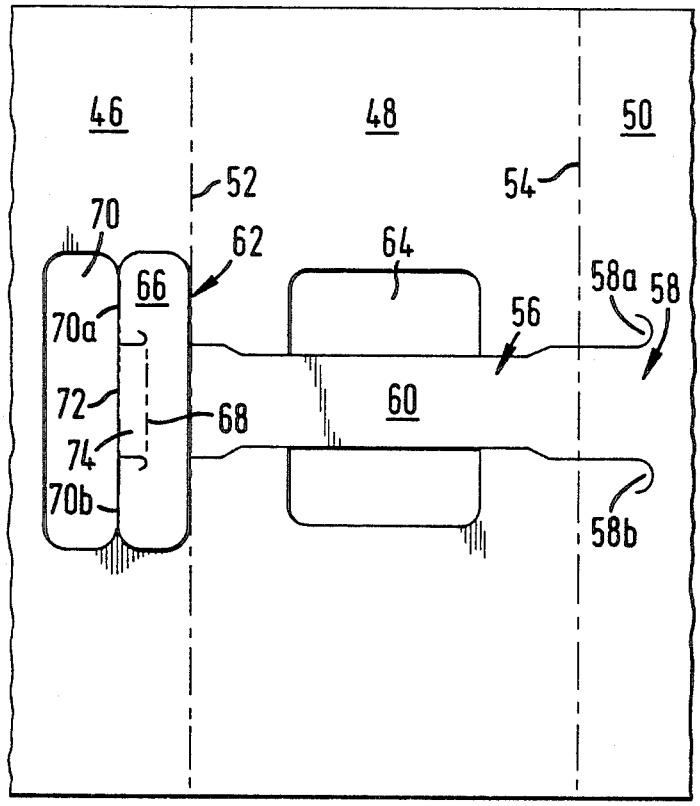
FIG. 7 is a plan view of the underside of the blank shown in FIG. 5.

Referring now to FIGS. 5 to 7 of the drawings, a part blank 44 formed from paperboard or similar foldable sheet material comprises a first side panel 46, a top panel 48 and a second side panel 50 hinged one to the next along fold lines 52 and 54, respectively.

A handle 56, comprising a strip of material stuck from the blank has one of its ends 58 integral with side panel 50; a central hand gripping portion 60 extending across the top panel 48; and the other of its ends 62 hinged to the side panel 46. The location of the ends of the handle in the side panels of the blank gives a construction which has better resistance to tear. In order to augment the tear resistance, the handle end 58 terminates in arcuate cut lines 58*a* and 58*b*. The central hand gripping portion of the handle spans a hand gripping aperture 64 struck centrally from the top panel 48.

Handle end 62 is hinged to a securing flap 66 which is stuck from side panel 46 along a fold line 68 located intermediate the ends of the securing flap. The securing flap is hinged to one edge of flap aperture 70, defining the securing flap, along fold lines 70*a* and 70*b* on either side of the handle. A fold line 72 spaced from and parallel to fold line 68 is formed in the handle which is coincident with fold lines 70*a* and 70*b*. Thus, gusset panel 74 is provided between fold lines 68 and 72 in the handle thereby allowing the handle to be extensible from a flat stowed position in which the central hand gripping portion 60 lies substantially in the plane of the blank to an extended position in which the central hand gripping portion 60 is raised out of the plane of the top panel. Preferably, fold line 72 is spaced from fold line 68 by a distance of between 5 mm to 10 mm.

In order to allow the gusset panel 74 to function as an extensible portion of the handle, the securing flap 66 is folded into flat overlapping relationship with side panel 46 so that the edge of the securing flap remote from fold lines 70*a* and 70*b* lies adjacent fold line 52. The securing flap is glued or otherwise fixed to side panel 46 on either side of the handle.

Figure 8:
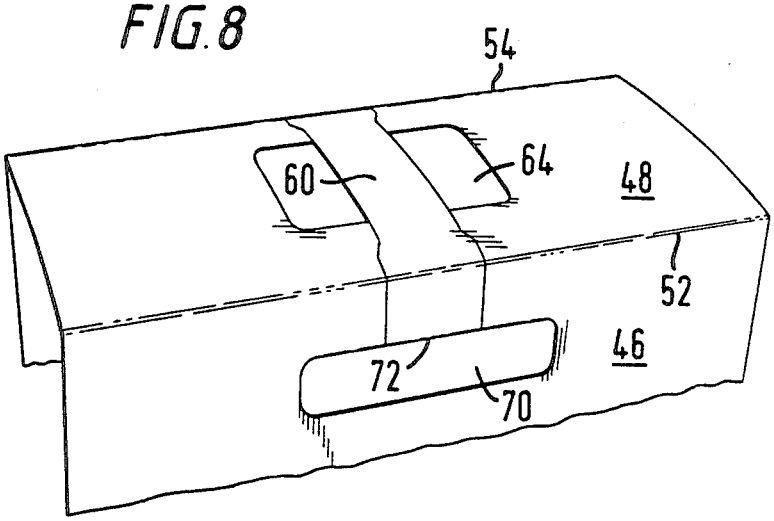
FIG. 8 is a perspective view of a notional carton formed from the part blank and in which the handle is shown in its stowed position.
Figure 9:
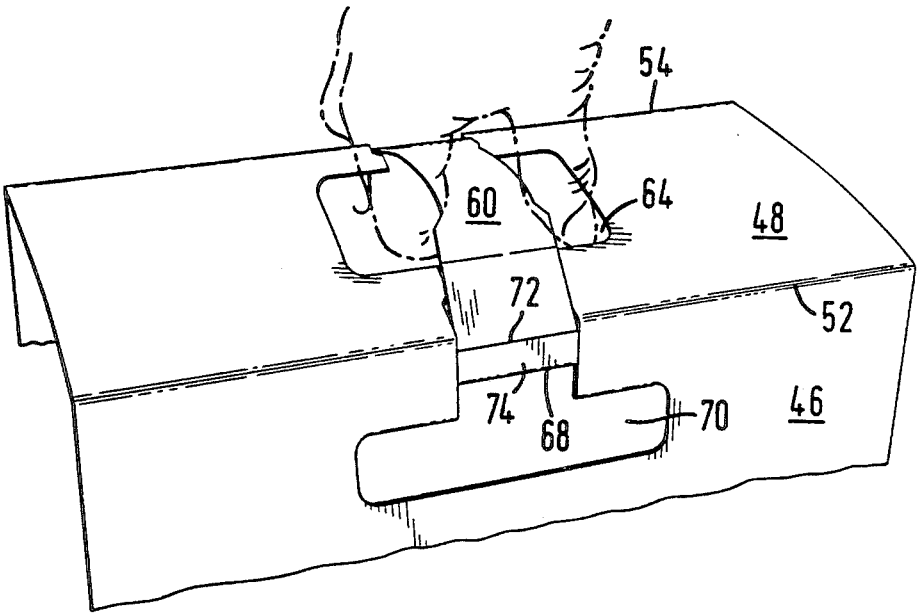
FIG. 9 is a view similar to FIG. 4 but in which the handle is shown raised and gripped to facilitate portage of the carton.

When the handle is in its stowed position, as shown in FIGS. 5, 7 and 8, the gusset 74 lies in flat superposed relationship under that part of the handle which is between fold lines 72 and 52 whereby the fold line 72 defines the marginal edge of the handle at end 62.

When the handle is grasped to lift the carton, the gusset 74 is rotated out of its flat superposed position by hinging about fold lines 68 and 72 so that the handle is extended by a length representing the distance between those fold lines. Thus, the handle can be manipulated so that its central hand gripping portion is raised out of the plane of the top panel whereby the fold line 68 defines the edge of the handle at end 62.

I claim:

1. In a packaging carton of the type having a top wall panel and spaced first and second side wall panels joined to said top wall panel along fold lines and wherein said wall panels have exposed outer surfaces and opposite interior surfaces, an extensible handle struck from and spanning across said top wall panel and having opposed ends of which one end is associated with said first side wall panel and the other end is associated with said second side wall panel, said handle comprising a central hand gripping portion arranged to be lifted from a flat stowed position within said top wall panel to a raised position extending above said top wall panel, a foldable end portion hinged to at least said one end of said handle and disposed in underlying relationship with said hand gripping portion when the latter is in stowed position and folded out when the handle is grasped to lfit the carton, and an end flap hinged to said end portion and secured to the interior surface of one of the adjacent wall panels, said end portion and said end flap being provided from material struck from said first side wall panel.

2. A packaging carton according to claim 1, further characterised in that said end flap is secured to the interior surface of said top panel.

3. A packaging carton according to claim 1, further characterised in that said end flap is secured to the interior surface of said first side wall panel.

4. A packaging carton according to claim 1, further characterised in that a hand gripping aperture is formed in said top panel adjacent said hand gripping portion to facilitate access to said handle.

5. A packaging carton according to claim 1, further characterised in that said other end of said handle is hinged to said second side wall panel along the joint thereof with said top wall panel.

* * * * *